US006079133A

United States Patent [19]

Netten

[11] Patent Number: 6,079,133

[45] Date of Patent: Jun. 27, 2000

[54] STEAM IRON WITH ANTICIPATING POWER CONTROL

[75] Inventor: Adriaan Netten, Drachten, Netherlands

[73] Assignee: U.S. Philips Corporation, New York, N.Y.

[21] Appl. No.: 09/181,157

[22] Filed: Oct. 28, 1998

[30] Foreign Application Priority Data

Oct. 29, 1997 [EP] European Pat. Off. ..... 97202564

[51] Int. Cl.[7] ..... D06F 75/24

[52] U.S. Cl. ..... 38/77.7

[58] Field of Search ..... 38/77.8, 77.83, 38/82, 77.1

[56] References Cited

U.S. PATENT DOCUMENTS

| | | | |
|---|---|---|---|
| 5,042,179 | 8/1991 | van der Meer | 38/77.8 X |
| 5,642,579 | 7/1997 | Netten et al. | 38/77.7 |

FOREIGN PATENT DOCUMENTS

| | | | |
|---|---|---|---|
| 5329300 | 12/1992 | Japan | 38/77.7 |
| 6165900 | 6/1994 | Japan | 38/77.83 |
| 2058898 | 7/1994 | Japan | 38/77.7 |
| 2266729 | 11/1993 | United Kingdom | 38/77.83 |
| 96/23099 | 8/1996 | WIPO . | |

*Primary Examiner*—Ismael Izaguirre
*Attorney, Agent, or Firm*—Ernestine C. Bartlett

[57] ABSTRACT

A steam iron comprises control device(s) for adjusting temperature and steam generation. The soleplate is heated with a heating element controlled by a control circuit which compares the desired temperature with the temperature of the soleplate measured with a temperature sensor. Steam is generated by transporting water from a water tank to a steam chamber which is thermally coupled to the soleplate. The control circuit adapts the power of the heating element upon activation of the steam generator in anticipation of the expected cooling down of the soleplate as a result of the transport of the water to be evaporated to the steam chamber.

15 Claims, 3 Drawing Sheets

STEAM IRON WITH ANTICIPATING POWER CONTROL

BACKGROUND OF THE INVENTION

The invention relates to a steam iron comprising: a soleplate; a heating element for heating the soleplate; a control circuit for controlling the temperature of the soleplate by activation of the heating element; a steam generator for generating steam, comprising a steam chamber which is thermally coupled to the soleplate, a water reservoir for holding the water to be evaporated, and a supply device for the controlled supply of water to be evaporated to the steam chamber; and means for activating the steam generator.

Such a steam iron is known from the International Publication (PCT) WO 96/23099. In steam irons of this type steam is generated by admitting an amount of water from the water reservoir to the steam chamber, where the water evaporates. The desired amount of steam can be adjusted by the user with the aid of the means for controlling the steam generator. The evaporation of the water in the steam chamber requires energy which is extracted from the soleplate to which the steam chamber is thermally coupled. The temperature decrease of the soleplate as a result of the steam production is compensated by the control circuit for controlling the temperature of the soleplate. However, such a control always lags behind the temperature decrease, which can sometimes be comparatively large and unexpected, for example when the user changes over from dry-ironing to steam-ironing or when the user gives a steam blast. As a result of this, the temperature of the soleplate, particularly in the case of a thin soleplate with a low thermal inertia, is subject to substantial temperature fluctuations.

SUMMARY OF THE INVENTION

It is an object of the invention to provide a steam iron which exhibits reduced temperature fluctuations. To this end, the steam iron of the type defined in the opening paragraph is characterized in that the control circuit further comprises means for adaptation of the activation of the heating element in response to the activation of the steam generator in anticipation of the expected cooling-down of the soleplate as a result of the supply of the water to be evaporated to the steam chamber.

In the steam iron in accordance with the invention the temperature decrease of the soleplate is anticipated by raising the average power at which the heating element operates as soon as the user demands steam production or increases the steam production. The means for adapting the activation of the heating element "know" how much extra power is needed to compensate for the temperature decrease of the soleplate on the basis of the construction of the steam iron, the instantaneous power of the heating element, the soleplate temperature and the requested amount of steam.

The requested amount of steam can be measured with the aid of the supply device. In an embodiment of the steam iron in accordance with the invention the supply device comprises an electrical pump. By measuring the operating time of the pump or by counting the number of energizing pulses of the electrical pump the amount of water which is evaporated can be measured fairly accurately.

The temperature decrease of the soleplate is anticipated by increasing the heat production of the heating element. In an embodiment the heating element is activated on the basis of a duty cycle control, the desired temperature of the soleplate being controlled by changing the duty cycle. During steam generation the duty cycle is given an extra offset which depends on the amount of steam to be generated.

BRIEF DESCRIPTION OF THE DRAWINGS

These and other aspects of the invention will be described and elucidated with reference to the accompanying drawings, in which.

DESCRIPTION OF THE PREFERRED EMBODIMENTS

Figure 1:
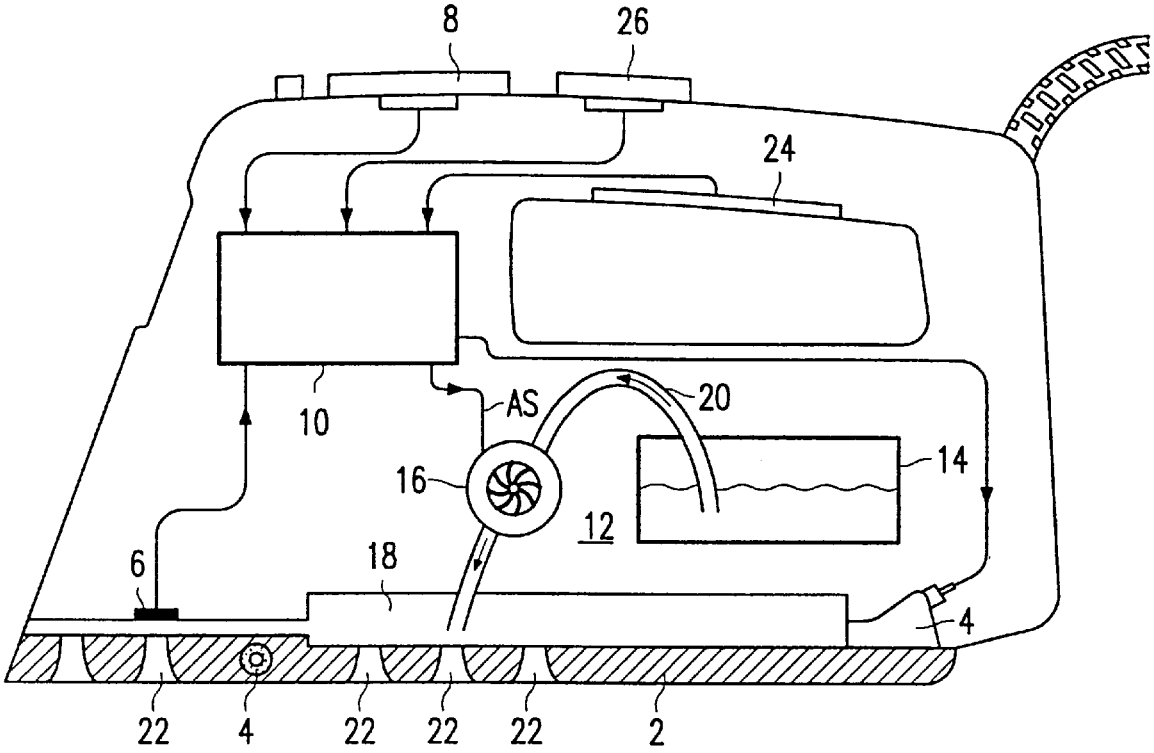
FIG. 1 is a sectional view of an embodiment of a steam iron in accordance with the invention.

FIG. 1 shows an embodiment of a steam iron in accordance with the invention. The steam iron comprises a conventional (thick) soleplate 2 which is heated by an electric heating element 4. The instantaneous temperature of the soleplate 2 is measured by means of a temperature sensor 6, for example a PTC resistor, an NTC resistor or a thermocouple element, which is thermally coupled to the soleplate 2. The desired soleplate temperature can be set by the user by means of a temperature selector or temperature control dial 8, but alternatively any other known control means such as push-buttons or touch controls can be used. A control circuit 10 compares the instantaneous temperature of the soleplate 10 with the desired temperature and controls the heat production of the heating element 4, for example by means of a triac in series with the heating element 4, in such a manner that the instantaneous temperature becomes equal to the desired temperature. Instead of the shown control using a temperature sensor 6 and a triac it is possible to use a more conventional control by means of a thermostat to control the temperature of the soleplate 2.

The steam iron further comprises a steam generator 12 having a water reservoir 14, a water pump 16 and a steam chamber 18 which is heated by the soleplate 2. The water pump 16 pumps water from the water reservoir 14 to the steam chamber 18 via a tube 20. The water evaporates in the steam chamber 18 and escapes via steam ports 22 formed in the soleplate 2. The supply of steam is controlled by means of an activation signal AS supplied by the control circuit 10 in response to a control signal from a control knob or control dial 26 by means of which the amount of steam to be produced can be set.

The steam iron further comprises an optional hand sensor 24 arranged in the handle of the steam iron. The hand sensor can be of any known type, for example a capacitive sensor. The hand sensor 24 informs the control circuit 10 whether or not the steam iron is in use.

As soon as the user switches from dry ironing to steam ironing by means of the control dial 26, or wishes to increase the steam production, or wishes to give a steam blast, the (increased) amount of water admitted to the steam chamber will cause the temperature of the soleplate 2 to decrease. This is because the evaporation of the water requires energy which is extracted from the soleplate 2 to which the steam chamber 18 is thermally coupled. As a result of this, the temperature of the soleplate 2 decreases. The decrease is measured by the temperature sensor 6 and is reported to the control circuit 10, which responds thereto by increasing the power output of the heating element 4. A similar situation occurs in the case of a thermostat control. However, the control circuit 10 can only respond when the temperature decrease of the soleplate 2 has already occurred, restoring the desired temperature of the soleplate 2 always being effected after the temperature decrease. As a consequence, the temperature of the soleplate 2 is subject to substantial temperature fluctuations, particularly upon a change-over from dry ironing to steam ironing and when steam blasts are given.

In accordance with the invention the temperature decrease which is due to occur is anticipated. For this purpose, the control circuit 10 comprises means which adapt the power output of the heating element 4 to the amount of steam to be produced. An amount of steam requested by means of the control dial 26 results in a given activation of the water pump 16. It is known how much water this water pump 16 (or any other supply device) conveys from the water reservoir 14 to the steam chamber 18. On the basis of the instantaneous power of the heating element 4, the instantaneous temperature of the soleplate 2 and the requested amount of steam it is possible to calculate how much extra heat the soleplate 2 should produce to compensate for the anticipated temperature decrease of the soleplate 2. This also depends on the construction of the steam iron. Factors which play a part are, for example, the thermal mass of the soleplate and the dimensions and the thermal coupling between the steam container 18 and the soleplate 2.

On the basis of this information, which is partly dynamic and partly depends on the construction of the steam iron, the control circuit 10 sets the power output of the heating element 4 to another value in the case of a changed demand for steam production. More steam requires more power from the heating element. This change in power output of heating element 4 in response to a change in the desired steam production is effected directly, i.e. without intervention of the temperature control. For example, in the case of a change from dry ironing to steam ironing the power the power of the heating element 4 is increased immediately by a value adequate to compensate for the expected temperature decrease.

The variation of the power of the heating element 4 can be effected in various ways. It is possible to connect one or more additional heating elements in order to meet the temporary higher demand for heat. A fine control is then possible by controlling the heat delivered by one of the additional heating elements by means of an electronic switch, for example on the basis of duty cycle control. Another possibility is to adapt the maximum power of the heating element 4 to the highest heat demand in the case of maximum steam production and at the highest ironing temperature and to control this power as required.

Figures 2A, 2B, 2C:
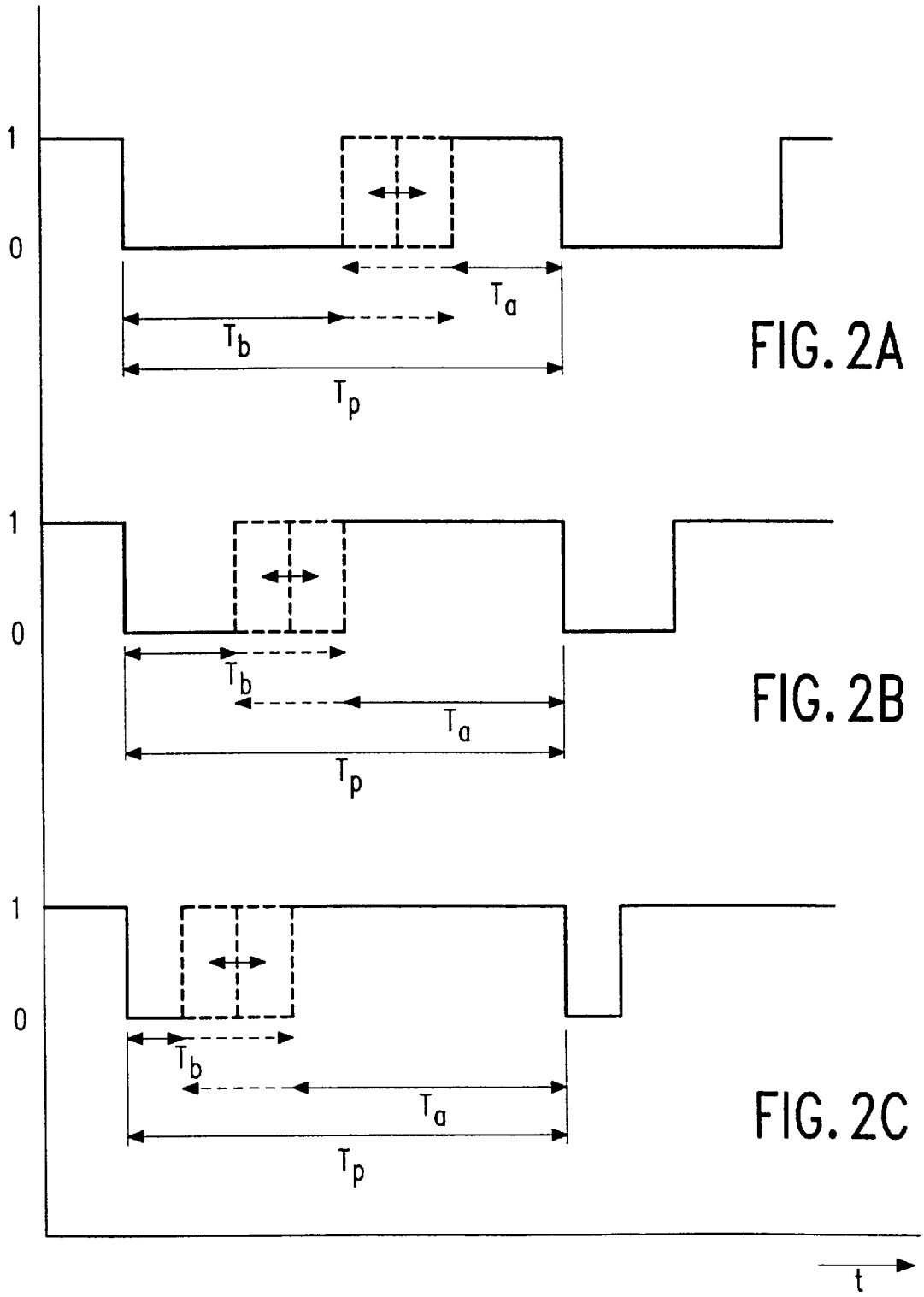
FIG. 2A, FIG. 2B and FIG. 2C show signal waveforms in explanation of a control system for power control of a heating element in a steam iron in accordance with the invention.

FIGS. 2A, 2B and 2C show control signals for power control of the heating element 4 on the basis of duty cycle control, an electronic switch (not shown) connecting the heating element 4 to the mains voltage if the control signal has the value "1" and disconnects it from the mains voltage if the control signal has the value "0". The period of the control signal is $T_p$. $T_a$ is the on time and $T_b$ is the off time. The sum of the on time $T_a$ and the off time $T_b$ is equal to the period $T_p$. In the case of a duty cycle of 0 the heating element 4 is switched off completely; in the case of a duty cycle of 1 the heating element 4 is constantly switched on. FIG. 2A represents the situation during dry ironing. The duty cycle $T_a/T_p$ then varies between two values indicated in broken lines. The variation is dependent on the temperature setting and/or the degree of cooling of the soleplate 2. It is to be noted that the values shown for the switching times have been given merely by way of example and may be different in actual practice. FIG. 2B represents the situation in the case of steam ironing with little steam. In this case, the instant at which the control signal changes over from 0 to 1 has shifted to the left, which results in an increase of the duty cycle and, consequently, of the average power delivered by the heating element 4. The shift to the left, i.e. the offset, and the consequent power increase depends on the amount of steam set by means of the control dial 26. FIG. 2C represents the situation in the case of steam ironing with much steam. In this case, the change-over point has shifted even more to the left (more offset) in order to meet the even greater heat demand. The shift of change-over point, and hence the offset, depends on the steam production set by means of the control disc 26. The variation of the change-over point, which is indicated in broken lines in FIGS. 2A, 2B and 2C and which is superposed on said shift, is caused by the temperature control, which is independent thereof.

Figure 3:
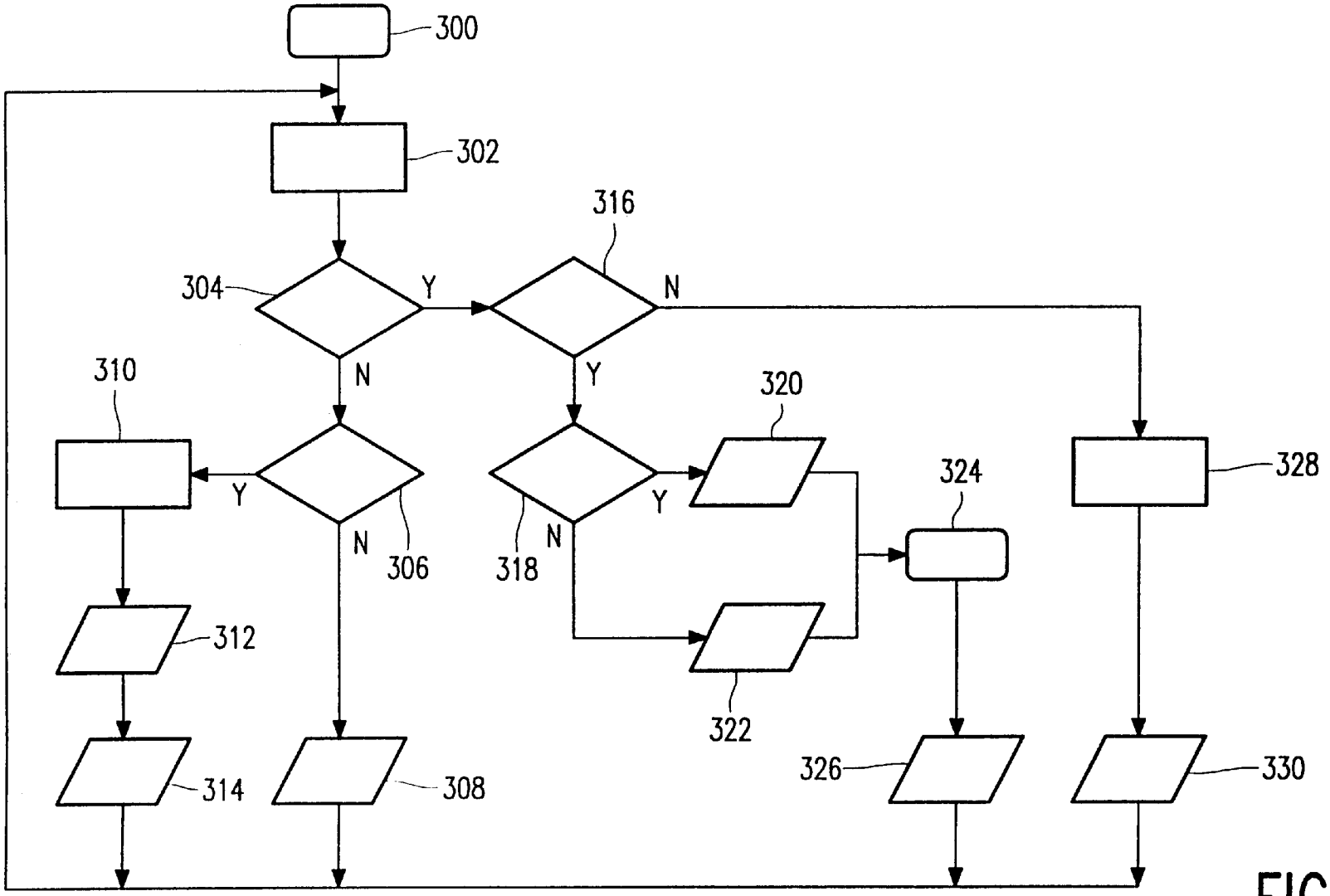
FIG. 3 is a flow chart of a control system for a steam iron in accordance with the invention.

FIG. 3 is a flow chart of a control system for controlling the power of the heating element 4. The inscriptions for FIG. 3 are listed in the following Table I:

TABLE I

| Block | Inscription |
|---|---|
| 300 | Start |
| 302 | Read $T_{set}$ |
| 304 | $-20°$ C. $< T_{err} < +20°$ C. ? |
| 306 | $T_{soleplate} > T_{set}$ ? |
| 308 | Output duty cycle = 1 |
| 310 | Calculate amount of steam |
| 312 | Output steam |
| 314 | Output duty cycle = 0 |
| 316 | Hand sensed ? |
| 318 | Steam required ? |
| 320 | Get Dc2 |
| 322 | Get Dc3 |
| 324 | Controller |
| 326 | Output duty cycle |
| 328 | No steam |
| 330 | Output Dc1 |

In the flow chart the following parameters are used: $T_{set}$ is the desired temperature set by means of the temperature control dial 8; $T_{soleplate}$ is the temperature of the soleplate 2 measured by means of the temperature sensor 6; $T_{err}=T_{soleplate}-T_{set}$; Dc1 is the offset in the duty cycle when the steam iron is in a rest position and is not used; Dc2 is the offset in the duty cycle during steam ironing; and Dc3 is the offset in the duty cycle during ironing without steam.

In a block 302 temperature setting $T_{set}$ of the soleplate 2 is determined. If it deviates too much from the desired temperature (block 304) it is examined whether the soleplate is too cold (block 306). If it is too cold, the full power is applied to heat the soleplate to the desired temperature (block 308), after which the block 302 is carried out again. If it is not too cold, the soleplate is too hot and should be allowed to cool down. This cooling down is expedited by evaporating water (fast cooling). The required amount of steam is calculated (block 310) and is generated by pumping water from the water reservoir 14 to the steam chamber 18. After this, the heating is turned off (block 314) and the program returns to the block 302.

If the temperature of the soleplate has come sufficiently close to the desired temperature (block 304) it is checked whether the hand sensor indicates that the steam iron is in use or not in use (block 316). If it is not in use, the steam production is turned off (block 328) and the power of the heating element 4 is set to a stand-by value of, for example, 100 W by selection of a suitable offset (block 330) and the program returns to the block 302. If the steam iron is in use it is checked whether steam is required (block 318). In this is not the case, the offset corresponding to dry ironing is selected (block 322); if steam is required, the offset corresponding to ironing with the selected amount of steam is chosen. The control circuit 10 (block 324) calculates the duty cycle (block 326), after which the program returns to the block 302. If desired, the control circuit 10 can operate on a fuzzy logic basis, in which case for example $T_{err}$ and the temperature variation of the soleplate as a function of time are divided into classes.

It will be evident that certain control operations and actions in the flow chart are optional and may therefore be omitted without detriment to the anticipating power control. Cooling down with water (blocks 310 and 312) may be omitted. The hand sensor and the stand-by feature may also be dispensed with (blocks 316, 328 and 330).

The sensor 24 in the handle serves to signal whether or not the iron is in use. Instead of or in addition to such sensor 24, a motion sensor or a position sensor can be used. If the steam iron is equipped with a stand, the presence of the iron on the stand can also be signalled by means of a switch which cooperates with projection on or a recess in the stand.

What is claimed is:

1. A steam iron comprising: a soleplate; a heating element for heating the soleplate; a control circuit for controlling the temperature of the soleplate by activation of the heating element; a steam generator for generating steam, comprising a steam chamber which is thermally coupled to the soleplate, a water reservoir for holding the water to be evaporated, and a supply device for the controlled supply of water to be evaporated to the steam chamber; and means for activating the steam generator, wherein the control circuit further comprises means for adjusting the power output of the heating element to a value determined by an amount of steam to be generated in response to the activation of the steam generator to compensate for a decrease in the temperature of the soleplate as a result of the controlled supply of the water to be evaporated to the steam chamber.

2. A steam iron as claimed in claim 1, wherein the supply device comprises an electrical water pump.

3. A steam iron as claimed in claim 2, wherein the means for adjusting the power output of the heating element to an amount of steam to be generated operate on the basis of a duty cycle control of the activation of the heating element, the increase of the duty cycle being dependent upon the amount of steam to be generated.

4. A steam iron as claimed in claim 2, wherein the control circuit further comprises means for activating the supply device if the soleplate has a temperature higher than a desired temperature.

5. A steam iron as claimed in claim 2, wherein the steam iron further comprises a sensor for detecting whether the steam iron is in use.

6. A steam iron as claimed in claim 5, wherein the sensor is a hand sensor arranged in a handle of the steam iron.

7. A steam iron as claimed in claim 1, wherein the means for adjusting the power output of the heating element to an amount of steam to be generated operate on the basis of a duty cycle control of the activation of the heating element, the increase of the duty cycle being dependent upon the amount of steam to be generated.

8. A steam iron as claimed in claim 7, wherein the control circuit further comprises means for activating the supply device if the soleplate has a temperature higher than a desired temperature.

9. A steam iron as claimed in claim 7, wherein the steam iron further comprises a sensor for detecting whether the steam iron is in use.

10. A steam iron as claimed in claim 9, wherein the sensor is a hand sensor arranged in a handle of the steam iron.

11. A steam iron as claimed in claim 1, wherein the control circuit further comprises means for activating the supply device if the soleplate has a temperature higher than a desired temperature.

12. A steam iron as claimed in claim 11, wherein the steam iron further comprises a sensor for detecting whether the steam iron is in use.

13. A steam iron as claimed in claim 12, wherein the sensor is a hand sensor arranged in a handle of the steam iron.

14. A steam iron as claimed in claim 1, wherein the steam iron further comprises a sensor for detecting whether the steam iron is in use.

15. A steam iron as claimed in claim 14, wherein the sensor is a hand sensor arranged in a handle of the steam iron.

* * * * *